US007669631B2

(12) United States Patent
Bailey et al.

(10) Patent No.: US 7,669,631 B2
(45) Date of Patent: Mar. 2, 2010

(54) ADHESIVE TAPE DISPENSER

(75) Inventors: Curt J. Bailey, Birmingham, MI (US); Kristen W. Chupa, Avon, OH (US); Dominic J. Daunter, Howell, MI (US); Noah E. A. Dingler, Waterford, MI (US); James K. Hawley, Sheffield Village, OH (US); Michael B. Lean, Bay Village, OH (US); Scott A. Sommers, Fairview Park, OH (US)

(73) Assignee: ShurTech Brands, LLC, Avon, OH (US)

( * ) Notice: Subject to any disclaimer, the term of this patent is extended or adjusted under 35 U.S.C. 154(b) by 1091 days.

(21) Appl. No.: 11/325,748

(22) Filed: Jan. 5, 2006

(65) Prior Publication Data

US 2006/0169709 A1 Aug. 3, 2006

Related U.S. Application Data

(63) Continuation-in-part of application No. 29/202,698, filed on Apr. 2, 2004, now Pat. No. Des. 520,061.

(51) Int. Cl.
*B65H 35/07* (2006.01)

(52) U.S. Cl. ..... 156/523; 156/574; 156/577; 156/579; D19/67

(58) Field of Classification Search ..... 156/574, 156/577, 579, 523, 527; 242/355; 225/77–79, 225/46–47
See application file for complete search history.

(56) References Cited

U.S. PATENT DOCUMENTS 4,884,734 A * 12/1989 Kahl et al. ..... 225/26
D326,474 S 5/1992 Luhman et al.
5,110,401 A 5/1992 Huang
5,164,038 A 11/1992 Sundqvist
D333,678 S 3/1993 Lissoni
5,197,386 A 3/1993 Lin
5,269,871 A 12/1993 Longworth et al.
5,328,115 A * 7/1994 Samuelson et al. ..... 242/588.6
5,419,775 A * 5/1995 Haffner et al. ..... 604/227
5,456,422 A 10/1995 Longworth
5,549,255 A 8/1996 Huang
5,641,377 A 6/1997 Chung et al.

(Continued)

*Primary Examiner*—Kat Wyrozebski
*Assistant Examiner*—Daniel Lee
(74) *Attorney, Agent, or Firm*—Fay Sharpe LLP

(57) ABSTRACT

A new and improved adhesive tape dispenser is adapted to dispense tape wound upon a tape core and includes a frame, an application roller, a cutter assembly, and handle mounted on the frame. The adhesive tape dispenser includes a core support assembly secured to the frame and having a first axis. The core support assembly comprises a shaft secured to the frame, and an axle assembly disposed about at least a portion of the shaft. A spindle adapted to support the tape core is rotatably mounted on the axle assembly. The axle assembly includes a hub having an outer surface with a second axis adjacent the first axis, at least one flange extending radially from the hub, and a cam rotatably mounted on the hub. The spindle freely rotates in a first direction. Wherein rotation of the spindle in a second direction rotates the cam about the second axis in the second direction whereby the cam engages the spindle preventing further rotation of the spindle in the second direction about the axle assembly.

38 Claims, 14 Drawing Sheets

U.S. PATENT DOCUMENTS

| | | | | | |
|---|---|---|---|---|---|
| 5,725,726 | A | | 3/1998 | Yu | |
| 5,776,301 | A | * | 7/1998 | Huang | 156/577 |
| 5,849,144 | A | * | 12/1998 | Tang et al. | 156/577 |
| 5,906,705 | A | * | 5/1999 | Chung et al. | 156/579 |
| D421,820 | S | | 8/1999 | Lee | |
| 5,947,025 | A | | 9/1999 | Huang | |
| 5,954,916 | A | | 9/1999 | Orlandi | |
| 6,159,328 | A | | 12/2000 | Gaikoski et al. | |
| 6,257,298 | B1 | | 7/2001 | Huang | |
| 6,540,002 | B1 | | 4/2003 | Edwards et al. | |
| 6,641,081 | B2 | | 11/2003 | Huang | |
| 6,651,718 | B2 | | 11/2003 | Hua | |
| 6,666,898 | B2 | | 12/2003 | Yu Chen | |
| 6,705,373 | B1 | | 3/2004 | Yu Chen | |
| 6,705,374 | B2 | * | 3/2004 | Yu Chen | 156/527 |
| 6,810,802 | B2 | | 11/2004 | Huang | |
| D520,061 | S | | 5/2006 | Daunter et al. | |
| 7,195,048 | B2 | * | 3/2007 | Wojtkun et al. | 156/527 |
| 2002/0195204 | A1 | | 12/2002 | Huang | |
| 2003/0173452 | A1 | | 9/2003 | Huang | |
| 2004/0016509 | A1 | | 1/2004 | Lissoni | |
| 2004/0089424 | A1 | | 5/2004 | McDonald | |
| 2004/0244917 | A1 | * | 12/2004 | Wojtkun et al. | 156/577 |
| 2006/0169709 | A1 | | 8/2006 | Bailey et al. | |
| 2007/0210205 | A1 | | 9/2007 | Tang | |
| 2007/0235494 | A1 | * | 10/2007 | Foran et al. | 225/39 |
| 2008/0257499 | A1 | | 10/2008 | Wojtkun | |

* cited by examiner

ADHESIVE TAPE DISPENSER

CROSS REFERENCE TO RELATED APPLICATIONS

This present application is a continuation-in-part of U.S. Design patent application Ser. No. 29/202,698 filed Apr. 2, 2004 now U.S. Pat. No. D 520,061, expressly incorporated herein by reference.

The present application further generally relates to the inventions disclosed in commonly owned U.S. patent application Ser. No. 10/454,000 filed Jun. 4, 2003; U.S. Design patent application Ser. No. 29/178,505 filed Mar. 27, 2003; and U.S. Design patent application Ser. No. 29/178,556 filed Mar. 27, 2003.

BACKGROUND OF THE INVENTION

The present invention generally relates to a hand-held adhesive tape dispenser.

Conventional hand-held tape dispensers typically include a main body having a handle, a tape reel provided at a rear side of the main body, a roller provided at a front side of the main body, a front plate located above the roller, a blade located above the front plate, and a holding-down plate located above and substantially normal to the blade.

To use the conventional hand-held tape dispenser, a free end of a roll of tape mounted on the tape reel is pulled to pass below the roller and attach to a surface of, for example, a packing box. By pressing and rotating the roller, a desired length of tape is firmly adhered to the packing box. Thereafter, the tape dispenser is lifted to press the holding-down plate against the tape applied on the packing box. At this point, the blade cuts the tape.

Conventional hand-held tape dispensers are, in many instances, not ergonomic devices. The tape dispensers have less than optimal weight distributions which effect the positioning of the tape dispenser at initial application of adhesive tape onto a surface and final cutting of a tape reel.

Conventional hand-held tape dispensers can also fail to properly manage a loose tape end. Thus, after the tape is cut off, there can be counter-rotation or backlash of the reel that would pull the loose end of the tape back into contact with the reel.

Another problem with conventional hand-held tape dispensers is the core size of the tape reels. Conventional hand-held tape dispensers generally do not have the capacity to accept different size tape reels and typical core adapters are insufficient to insure that the tape roll would be guided into a good fit. One who has experience with conventional hand-held tape dispensers will be aware of still further deficiencies and difficulties that one must confront in utilizing such devices.

In light of the foregoing, it becomes evident that there is a need for a hand-held adhesive tape dispenser that would provide a solution to one or more of the deficiencies from which the prior art and/or conventional hand-held tape dispensers have suffered.

BRIEF DESCRIPTION OF THE INVENTION

In an exemplary embodiment of the present invention, a new and improved adhesive tape dispenser is provided. The adhesive tape dispenser is adapted to dispense tape wound upon a tape core and typically includes a frame, an application roller, a cutter assembly and handle mounted on the frame.

In accordance with an aspect of the present invention, the adhesive tape dispenser includes a core support assembly secured to the frame and having a first axis. The core support assembly comprises a shaft secured to the frame, and an axle assembly disposed about at least a portion of the shaft. A spindle adapted to support the tape core is rotatably mounted on the axle assembly. The axle assembly includes a hub having an outer surface with a second axis adjacent the first axis, at least one flange extending radially from the hub, and a cam rotatably mounted on the hub. The spindle freely rotates in a first direction. Rotation of the spindle in a second direction rotates the cam about the second axis in the second direction whereby the cam engages the spindle preventing further rotation of the spindle in the second direction about the axle assembly.

In accordance with another aspect of the present invention, an anti-reverse hub assembly for the adhesive tape dispenser is provided. The anti-reverse hub assembly comprises a shaft secured to the frame and a generally cylindrical member disposed about a portion of the shaft. At least one flange extends radially from the cylindrical member. A cam is rotatably mounted on the cylindrical member.

In accordance with yet another aspect of the present invention, the adhesive tape dispenser includes a hub assembly rotatably secured to the frame. A spindle adapted to support a roll of tape upon a core of a first diameter is rotatably mounted on the hub assembly and includes a slot located on an external surface of the spindle. A spindle adapter adapted to support a roll of tape upon a core of a second diameter larger than the first core diameter includes a resilient finger and a tab extending radially inward from the finger. The tab is adapted to be secured in the slot of the spindle for selectively securing the spindle adapter to the spindle.

In accordance with still yet another aspect of the present invention, the adhesive tape dispenser includes a spindle adapter selectively secured to the spindle. The spindle adapter is adapted for a tape roll having a tape core having a diameter larger than an outer diameter of the spindle. The spindle adapter comprises three contact members symmetrically disposed about an outer surface of the spindle adapter. The contact members engage and support the tape core in at least six locations around the tape core.

In accordance with a further aspect of the present invention, the adhesive tape dispenser includes a press plate assembly for pressing tape into adhesive contact with a substrate and moving a cutting blade. The press plate assembly includes a rigid reinforcement plate and a resilient plate adjacent to the reinforcement plate. The rigid reinforcement plate has a generally curved first end portion and a second end portion operatively secured to a cutter assembly. Wherein the reinforcement plate relieves stress applied to the resilient plate when the resilient plate is pressed against adhesive tape applied onto a surface of a product.

In accordance with yet a further aspect of the present invention, the adhesive tape dispenser comprises a frame; a handle mounted on the frame and defining a longitudinal axis; a cutter assembly mounted on the frame; an application roller secured adjacent the cutter assembly and having a first axis; and a hub assembly rotatably mounted to the frame and having a second axis. A first plane contains the application roller first axis and the hub assembly second axis. The longitudinal axis of the handle intersects at an acute angle with the first plane. The second axis of the hub assembly is spaced from the longitudinal axis of the handle toward the application roller axis. The hub assembly, acting as a mass, creates a downward cantilevered effect on the tape dispenser relative to the longitudinal axis of the handle thereby urging a front end of the tape dispenser against a surface of a product. This optimizes positioning of the tape dispenser at initial application of adhesive tape onto the surface and final cutting of a tape roll.

Still other aspects of the invention will become apparent from a reading and understanding of the detailed description of the preferred embodiments hereinbelow.

BRIEF DESCRIPTION OF THE DRAWINGS

The present invention may take physical form in certain parts and arrangements of parts, preferred embodiments of which will be described in detail in this specification and illustrated in the accompanying drawings which form a part of the invention.

DETAILED DESCRIPTION OF THE INVENTION

It should, of course, be understood that the description and drawings herein are merely illustrative and that various modifications and changes can be made in the structures disclosed without departing from the spirit of the invention. Like numerals refer to like parts throughout the several views.

Figure 1:
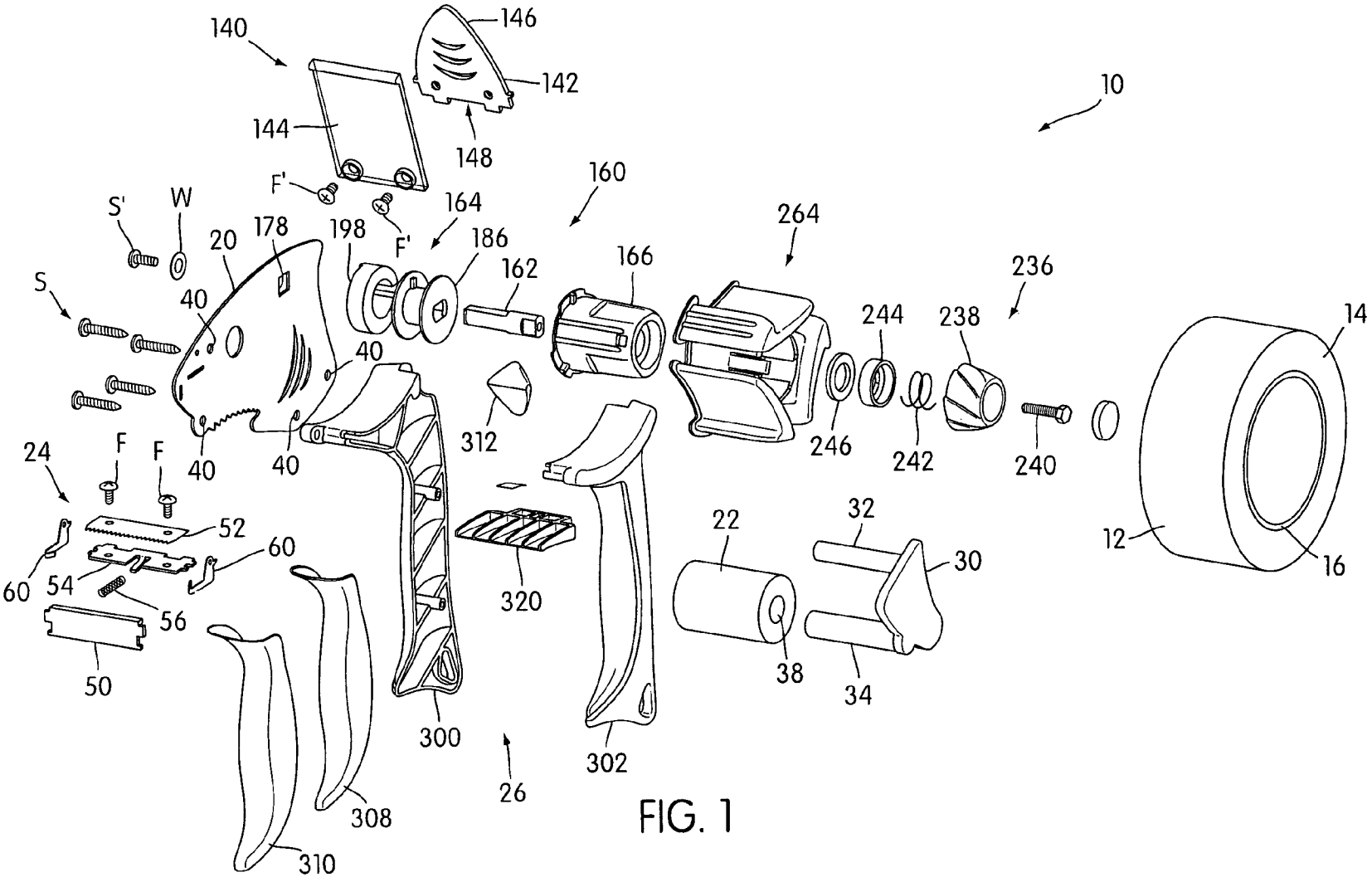
FIG. 1 is an exploded front perspective view of an adhesive tape dispenser according to a preferred embodiment of the present invention.

Referring now to the drawings, wherein the showings illustrate an exemplary embodiment of the present invention only and are not intended to limit same, FIG. 1 shows an adhesive tape dispenser 10 adapted for ergonomic application of adhesive film or tape 12 from a roll 14 onto an application surface (not shown). The tape 12 is typically wound around a cardboard core in a well known manner. The adhesive tape dispenser 10 is particularly useful in dispensing tape wound on a first smaller diameter core (not shown), generally a one inch core, and tape wound on a second larger diameter core 16, generally a three inch core. The adhesive tape dispenser 10 generally includes a frame 20, an application roller 22 and a cutter assembly 24 at one end of the frame, and a handle assembly 26 at the other end of the frame. The application roller and cutter assembly are secured at one end to the frame and at the other end to a side plate 30.

The side plate 30 includes first and second spaced apart column-shaped support rods 32, 34 provided at a proper position above and below the cutter assembly 24. The second rod 34 is inserted in an opening 38 of the application roller 22 thereby rotatably securing the application roller on the tape dispenser 10. Each support rod includes a mounting aperture (not shown) which is aligned with selected openings 40 in the frame 20. Conventional screws S extend through the openings 40 and threadedly engage the mounting apertures, thus securing the side plate 30 to the frame 20. It should be appreciated that the openings 40 have a diameter smaller than the dimension of the screw head thereby eliminating the need for a washer.

Figure 2:
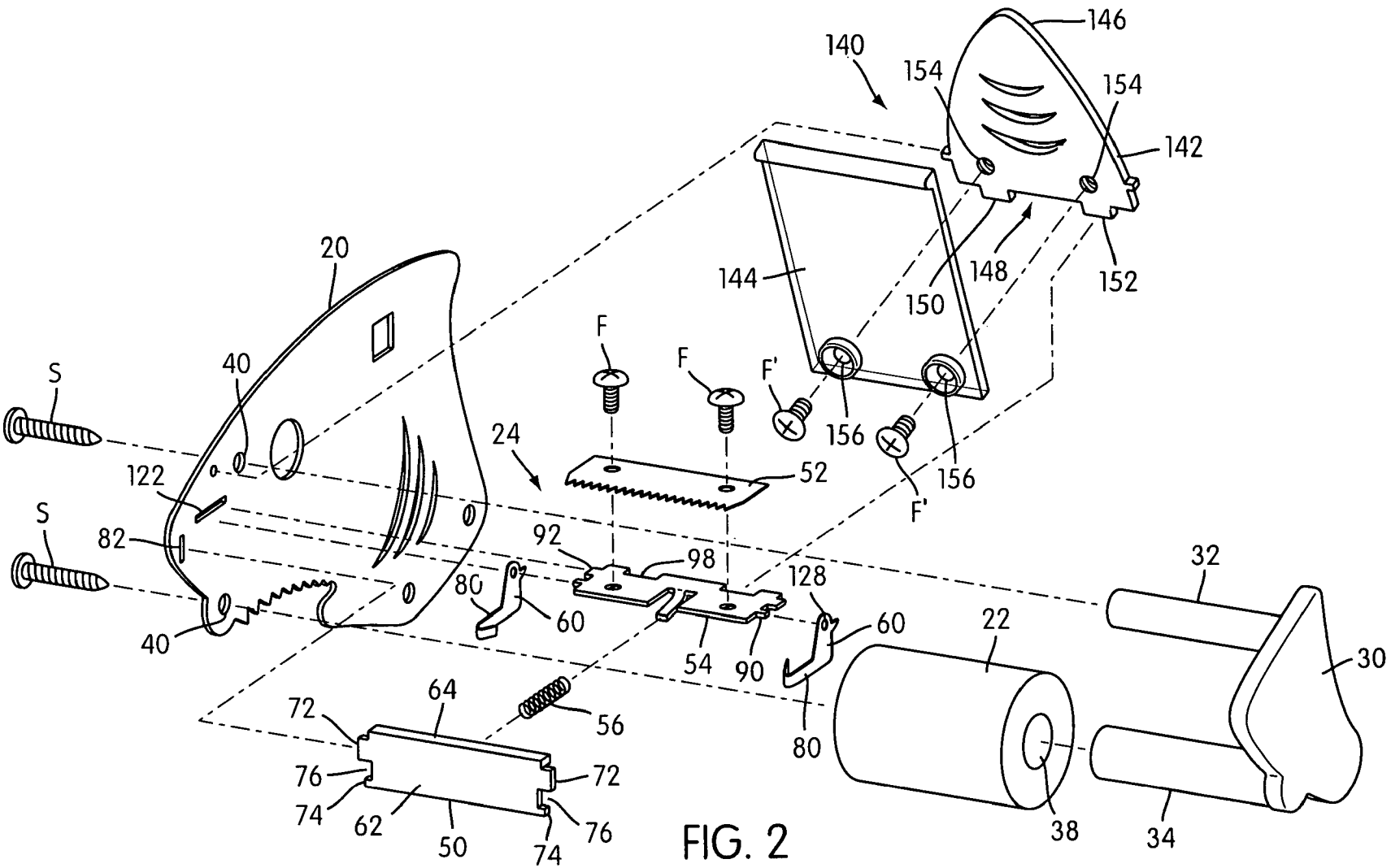
FIG. 2 is an enlarged exploded front perspective view of a cutter assembly and press plate assembly of the adhesive tape dispenser of FIG. 1.
Figure 3:
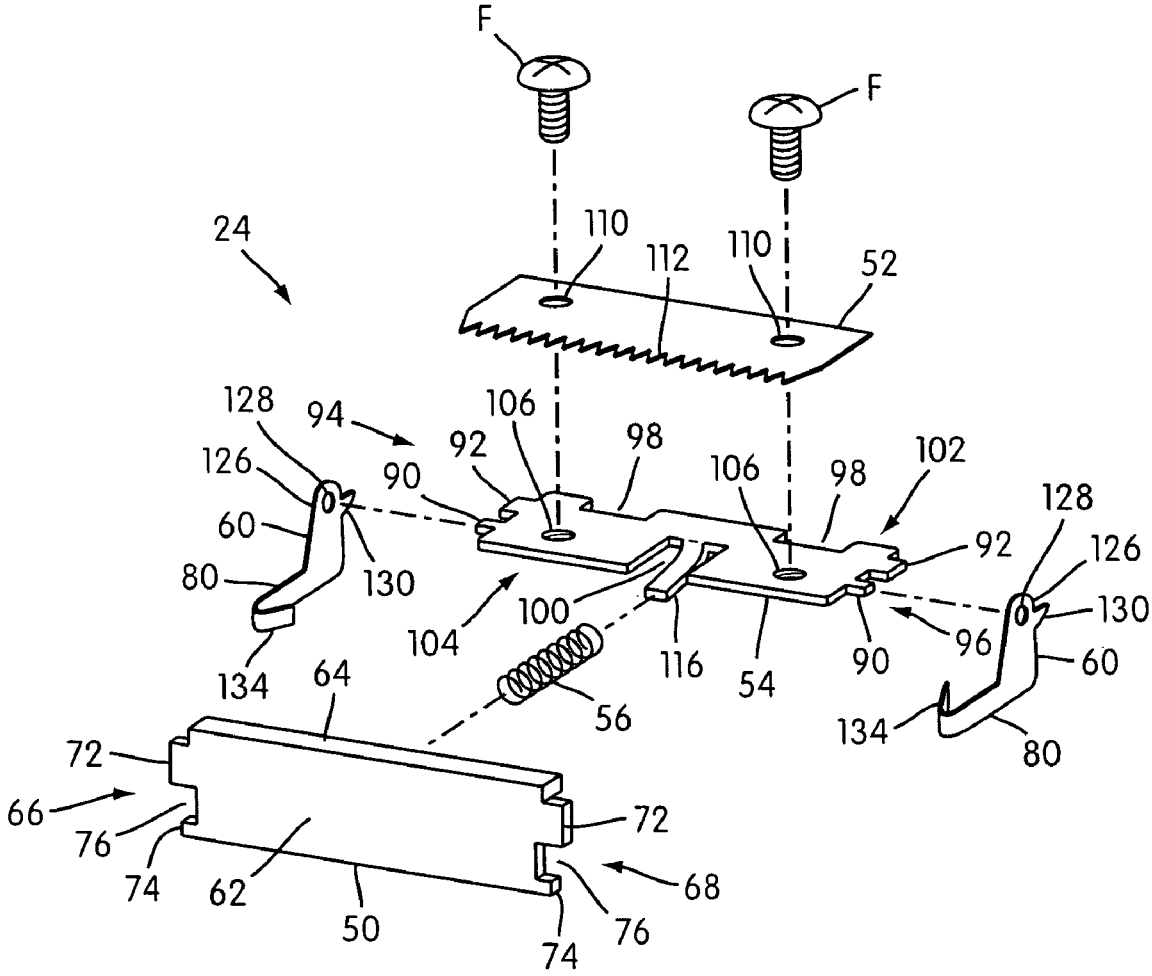
FIG. 3 is an enlarged exploded front perspective view of the cutter assembly of FIG. 2.
Figure 4:
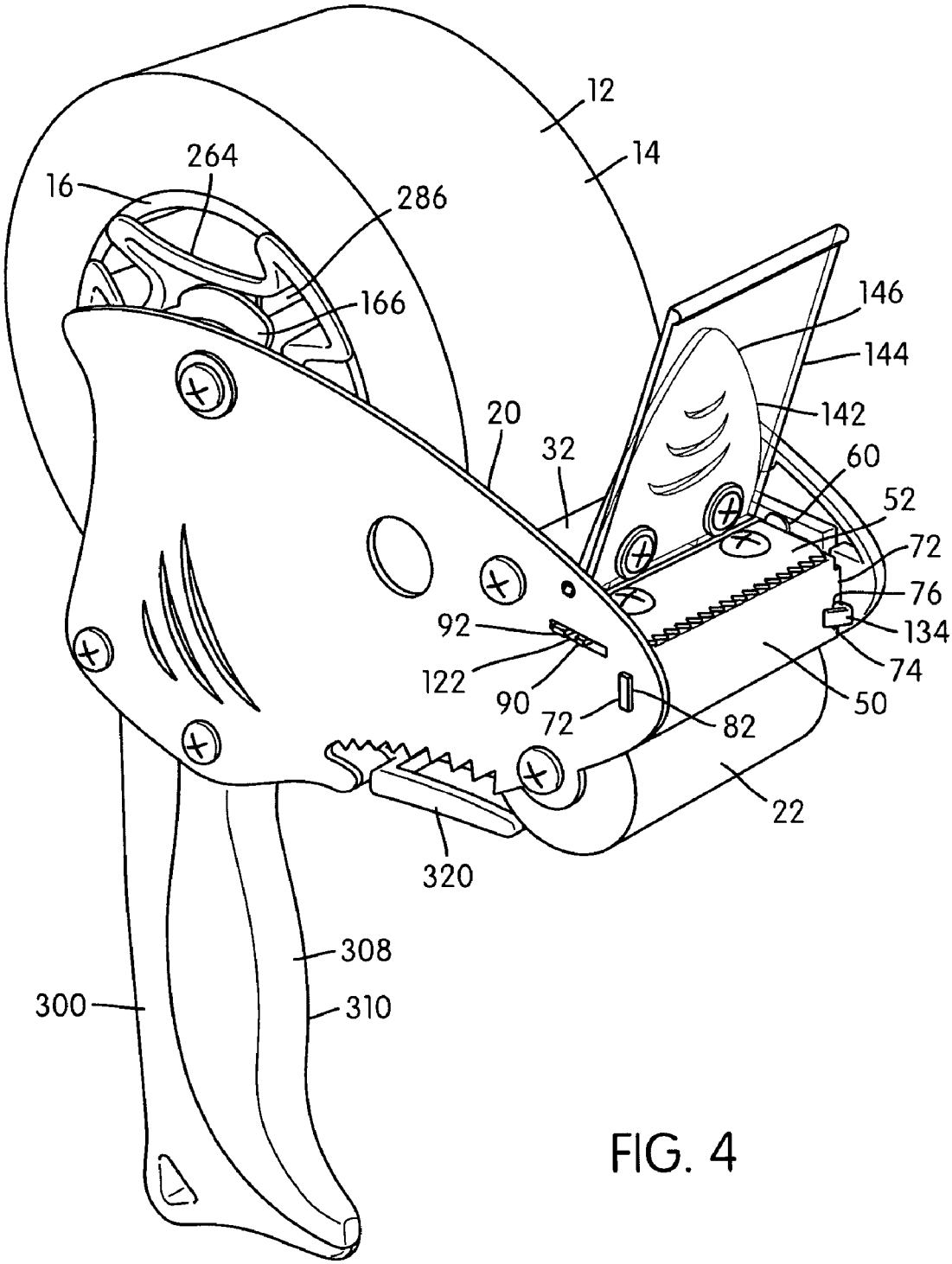
FIG. 4 is an assembled side perspective view of the adhesive tape dispenser of FIG. 1.

With reference to FIGS. 2-4, the cutter assembly 24 comprises a front plate 50, a blade 52, a top plate 54, a spring 56 and two generally L-shaped plates 60 fixed to opposing sides of the top plate.

The front plate 50 is generally L-shaped and includes a first portion 62 and a second portion 64 extending generally perpendicular to the first portion. Extending from each side 66, 68 of the first portion 62 is a first tab 72 and a second tab 74, the tabs defining a notch 76 dimensioned to receive a leg 80 of each L-shaped plate 60. As shown in FIG. 4, the tabs 72 secure the front plate 50 to the frame 20 and the side plate 30. Particularly, tab 72 of side 66 is received in a slot 82 located on the frame 20 while tab 72 of side 68 is received in a slot (not shown) integrally formed in the side plate 30.

Figure 5:
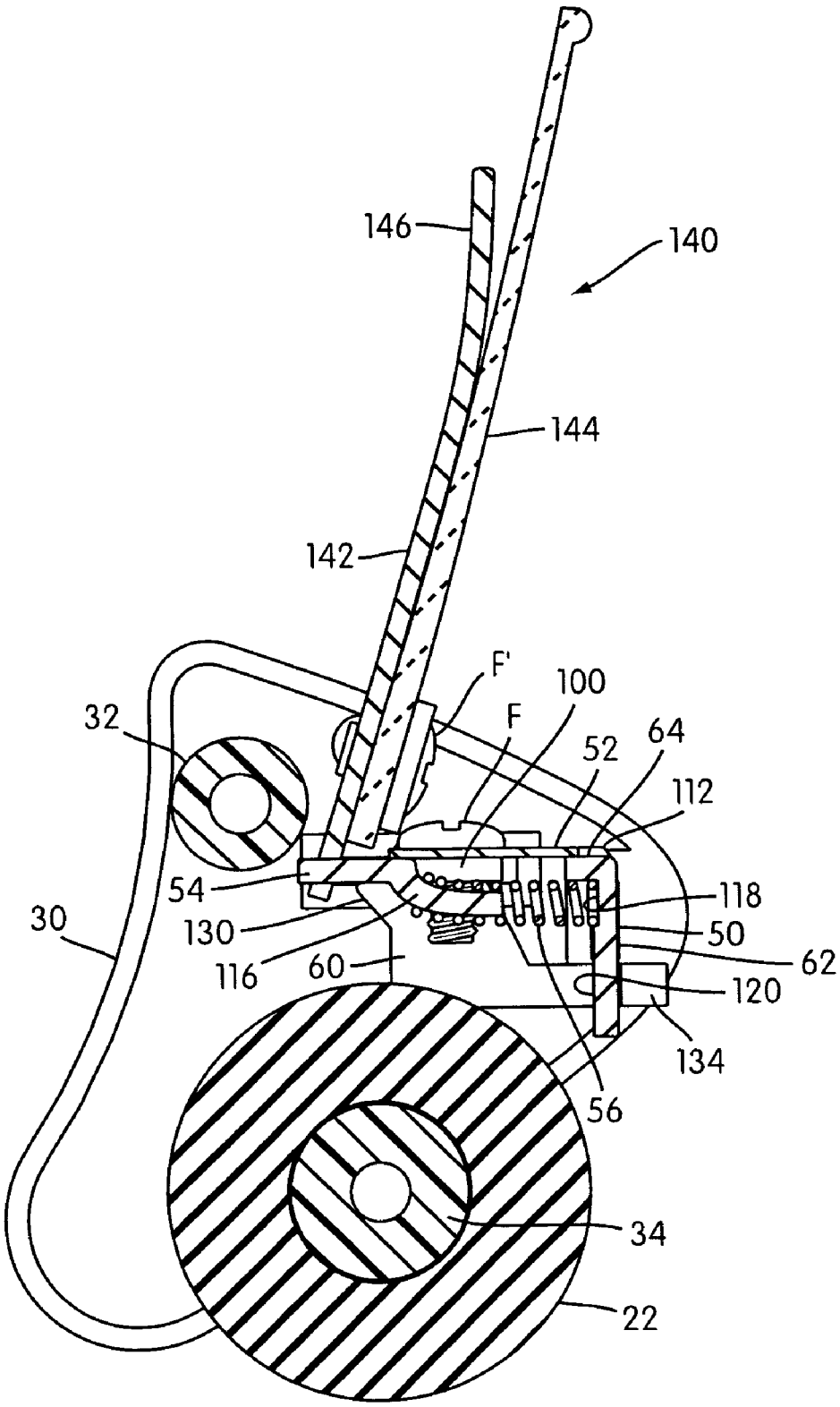
FIG. 5 is an enlarged cross-sectional view of the cutter assembly and press plate assembly of FIG. 2 in a first position.

With reference to FIGS. 2 and 3, the top plate 54, which lies substantially on the same plane as the second portion 64 of the front plate 50, includes first and second projections 90, 92 extending from first and second opposing sides 94 and 96. A pair of spaced notches 98 and a central notch 100 extends inward from third and fourth opposing sides 102 and 104, respectively. The top plate 54 further includes a pair of apertures 106, which can include an internal thread, corresponding to a pair of apertures 110 located on the blade 52. The blade 52 is fixedly secured to the top plate 54 by a pair of conventional fasteners F extending through the blade apertures 110 and threading engaging the top plate apertures 106. As shown in FIG. 5, once secured, a cutting portion 112 of the blade extends beyond the fourth side 104 of the top plate 54 and generally rests on the second portion 64 of the front plate 50. The top plate 54 is connected to the front plate 50 by the spring 56, the spring engaging a finger 116 extending toward the front plate 50 from the notch 100 at one end and a recess 118 located on a back surface 120 of the front plate 50 at the other end. The blade can move forward and backward within a predetermined range relative to the front plate 50. The spring 56 biases the blade 52 and top plate 54 to a back, resting position.

Similar to the front plate 50, the top plate 54 is secured at one end to the frame 20 and at the other end to the side plate 30. Particularly, and as shown in FIGS. 2 and 4, the pair of projections 90 and 92 are received in a slot 122 located on the frame 20 and a corresponding slot (not shown) integrally formed in the side plate 30. The slots allow the top plate 54 to move forward and backward relative to the front plate 50.

With continued reference to FIGS. 2 and 3, the two generally L-shaped plates 60 are mounted to the first and second sides 94, 96 of the top plate 54. Each L-shaped plate 60 includes a rear upper section 126 having a fixing hole 128 for engaging with the projection 90 of the top plate 54 and a backwardly extending stopper 130 for pressing against a bottom surface of the top plate behind the second projection 92 (FIG. 5). The leg 80 of each L-shaped plate 60 extends forward by a predetermined length and has a hooked front end 134 that is normally exposed from one side of the front plate 50 below the blade 52. When the blade is pushed forward by a press plate assembly 140 mounted to the top plate 54 to cut dispensed tape, the L-shaped plates 60 connected to the sides 94, 96 of the top plate 54 move forward along with the blade 52. After the blade operates to cut the dispensed tape, the hooked front ends 134 of the L-shaped plates 60 move back toward the front plate 50 and engage the tape near the tape edges adjacent the tape free end to hold the latter against the front plate 50 for use next time.

Figure 6:
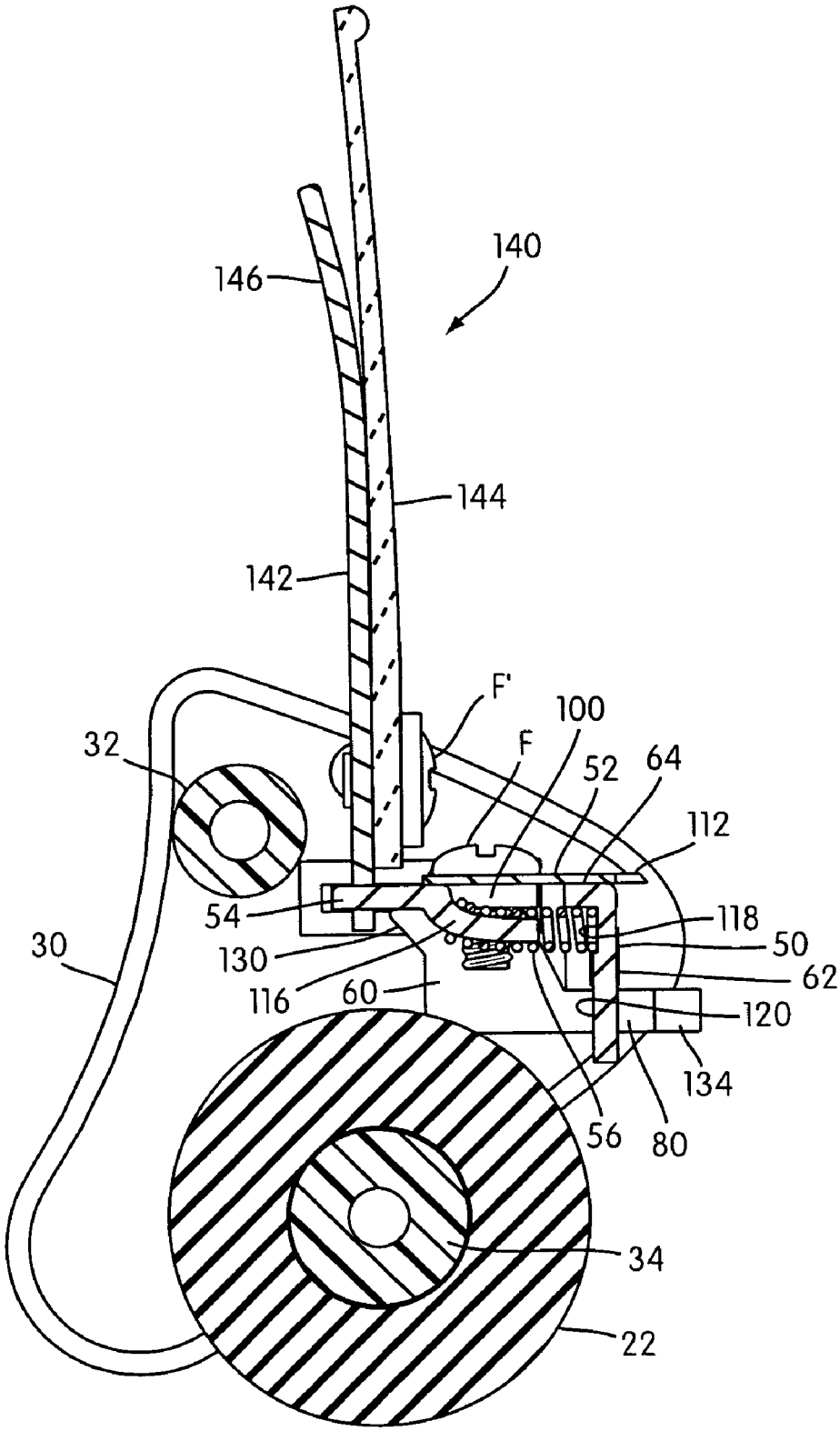
FIG. 6 is an enlarged cross-sectional view of the cutter assembly and press plate assembly of FIG. 2 in a second position.

With reference again to FIG. 2, and additional reference to FIGS. 5 and 6, the press plate assembly 140 includes a rigid reinforcement plate 142 and a resilient plate 144 adjacent to the reinforcement plate. The rigid reinforcement plate 142 has a generally curved first end portion 146 and a second end portion 148. First and second tabs 150 and 152 extend from the sides of the reinforcement plate 142 just above the second end portion 148. The tabs 150, 152 engage the notches 98 in the top plate 54. The press plate assembly is thereby held in place but free to rotate about on axis defined by a line between the two tabs 150, 152. The rigid reinforcement plate second end portion 148 operatively engages the cutter assembly 24. Particularly, the tabs 150, 152 of the reinforcement plate 142 have the same spacing and dimension as the notches 98 of the top plate 54 such that the tabs are received in the notches. The reinforcement plate further includes a pair of apertures 154, which can include an internal thread, which correspond to a pair of apertures 156 located on the resilient plate 144. The resilient plate 144 is fixedly secured to the reinforcement plate 142 by a pair of conventional fasteners F' extending through the resilient plate apertures 156 and threadingly engaging the rigid plate apertures 154. Thus, when the cutoff blade 56 is biased into a rest position, the press plate assembly is also biased into a rest portion with the first end portion 146 rotated in a forward position.

In use, the press plate assembly 140 with the cutter assembly 24 can protect a user from exposure to the blade 56. The press plate assembly also performs other functions in addition to protecting a user from contact with the tape dispenser's cutoff blade 56. The reinforcement plate 142 relieves stress applied to the resilient plate 144 when the resilient plate is pressed against the dispensed tape applied onto a surface of a product. In this embodiment, the curvilinear reinforcement plate 142 has a general tongue conformation, although, it should be appreciated by one skilled in the art that the reinforcement plate can have other contours for relieving stress applied to the resilient plate.

The operation of the cutter assembly 24 and press plate assembly 140 is illustrated in FIGS. 5 and 6. FIG. 5 illustrates the press plate assembly 140 in the rest position. The blade 56 and top plate 54 are biased into a rear position by the spring 56. The blade 56 leading edge is disposed behind the front surface of the plate 50. This is a non-cutting position. Tape may slide past the front plate 50 without being cut by the blade.

As illustrated in FIG. 6, when the press plate assembly 140 is brought to press against a length of dispensed tape (not shown), the press plate assembly rotates about the tabs 150, 152 and pushes the top plate 54 and the blade 56 forward thereby compressing the spring 56. The blade will project from the front plate 50 and cut the dispensed tape. When the tape dispenser 10 is lifted to release the press plate assembly 140 from the dispensed tape, the press plate assembly returns to its rest position and the top plate 54 and the blade 56 are pushed backward by the spring 56 to locate the top plate and the blade behind the front plate 50 again. As discussed above, this action also pulls the hooked front ends 134 of each L-shaped plate 60 back toward the front plate 50 and captures the tape free end.

Figure 7:
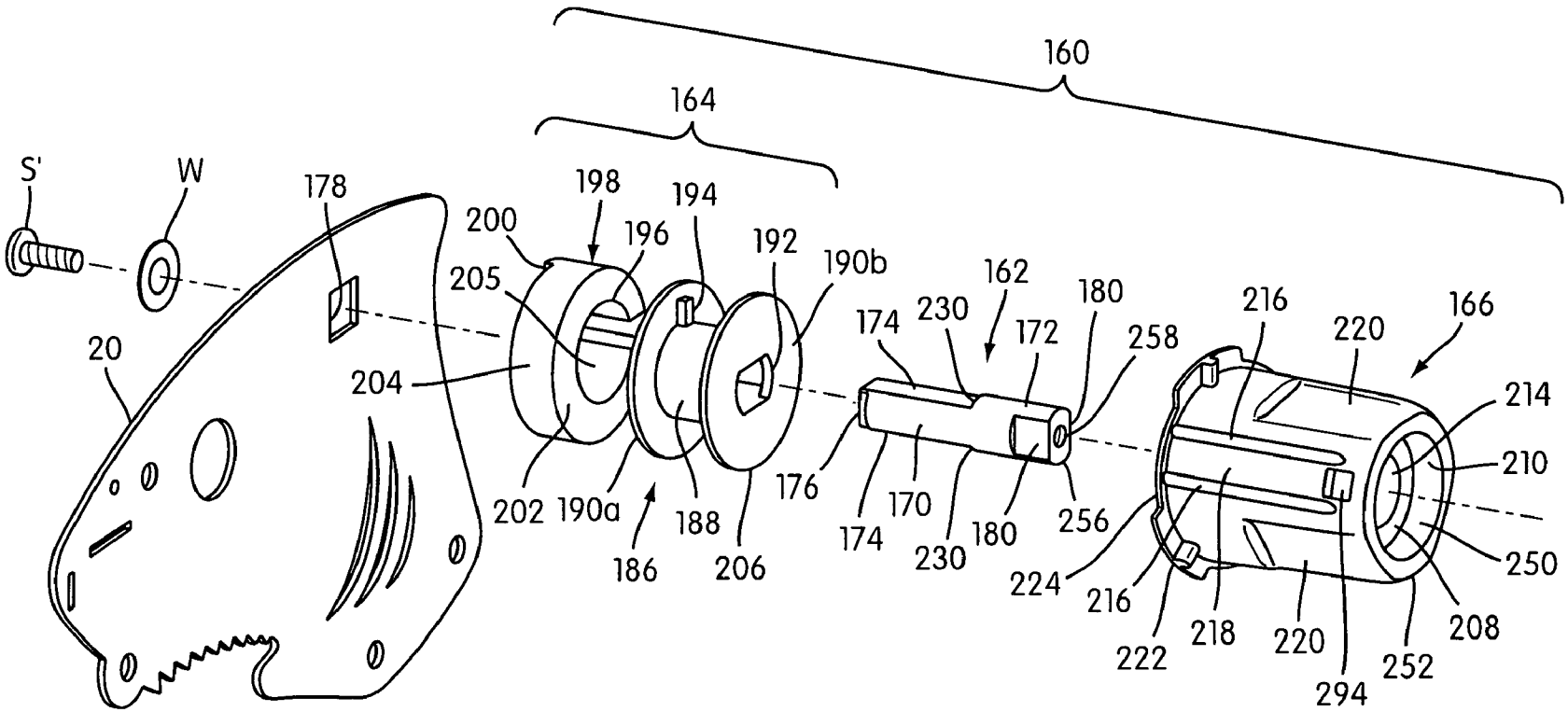
FIG. 7 is an enlarged exploded front perspective view of a core support assembly of the adhesive tape dispenser of FIG. 1.

With reference now to FIG. 7, the tape dispenser 10 further includes a core support assembly 160 mounted to the frame 20. The core support assembly defines a first axis about which a roll of adhesive tape turns. The core support assembly generally comprises a shaft 162, an axle assembly 164 and a spindle 166 adapted to support the first diameter tape core.

The shaft 162 is generally cylindrical in cross-section and has a shaft axis which is coincident with the first axis of the core support assembly. The shaft includes a first portion 170 adapted to be secured to the frame 20 and a second portion 172. The first portion comprises at least one planar section 174 which prevents rotation of the shaft relative to the frame 20. In the present embodiment, the first portion has two diametrically opposed planar sections. An end 176 of the first portion has four planar sections, the end being generally rectangular cross-section. The end 176 is received in an opening 178 in the frame. As will be discussed in greater detail below, the second portion 172 of the shaft also comprises at least one planar section 180 for engaging the spindle 166.

As shown in FIG. 7, the axle assembly 164 is disposed about the first portion 170 of the shaft 162. The axle assembly includes a generally cylindrical hollow hub 186 having an outer surface 188. At least one flange extends radially from an end of the hub. The flange has an outside diameter slightly smaller than an inside diameter of the spindle 166 thereby allowing the spindle to slide over the axle assembly. In the present embodiment, a pair of flanges 190*a*, 190*b* extends radially from opposing ends of the hub 186. The hub 186 has a central axial opening 192 dimensioned to receive the first portion 170 of the shaft 162. The hub defines a second axis which is adjacent the first axis of the core support assembly 160.

Figure 8:
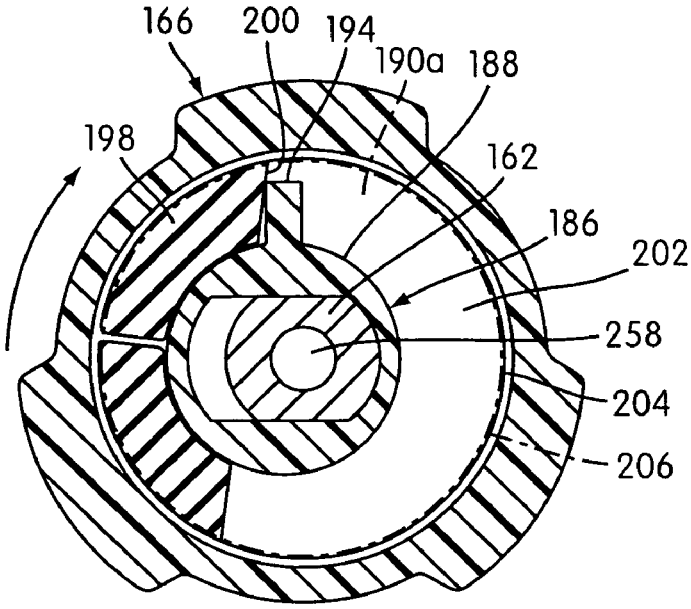
FIG. 8 is a cross-sectional view of an axle assembly of the adhesive tape dispenser of FIG. 1 rotating in a first direction.

The hub 186, which can be a unitary molded part, further includes a stop member 194. The stop member can be disposed adjacent one of the flanges 190*a*, 190*b* and extends radially from the outer surface 188 of the hub 186. In operation, and as will be discussed in greater detail below, the stop member 194 limits rotation of a cam 198 rotatably mounted on the hub 186 in a first direction and a second direction (FIGS. 8 and 9).

With continued reference to FIG. 7, the cam 198 is an integral part comprising a central cylindrical opening 196 having an axis coincident with the hub second axis, an outer cylindrical wall 204, first and second generally planar sidewalls and a slot cut completely through its body. The cam further includes a shelf 200 extending axially from the second sidewall. The shelf can engage the stop member 194 as the cam rotates about the hub 186 in either the first or second direction. It should be appreciated by one skilled in the art that the cam 198 is generally a radial or disc type cam having a body portion 202 with an eccentric conformation. The body portion 202 is centered about a third axis.

In use, the axle assembly 164 operates as an anti-reverse mechanism for the tape dispenser 10. As illustrated in FIG. 8, as the spindle 166 rotates about the axle assembly 164 about the first axis in the first direction, the spindle frictionally engages the cam 198. An inner surface 205 of the cam 198 will rotate about the second axis defined by the hub 186 in the first direction and the body portion 202 will rotate about the third axis in the first direction. The cam 198 will rotate in the first direction until the shelf 200 engages the stop member 194. At this first position, the third axis is coincident with the first and shaft axes and the outer surface 204 of the body portion 202 is concentric with edges 206 of the flanges 190*a*, 190*b*. As such, in the first position, the spindle 166 has an inside diameter slightly larger than the outside diameter of the axle assembly 164 as the cam 198 rotates in the first direction about the hub 186. Thus, the spindle 166 freely rotates about the axle assembly in the first direction.

Figure 9:
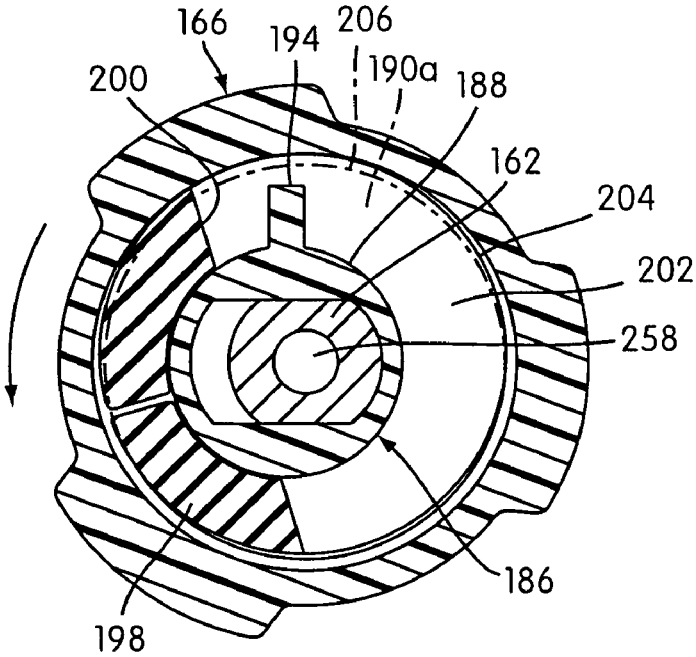
FIG. 9 is a cross-sectional view of the axle assembly of the adhesive tape dispenser of FIG. 1 rotating in a second direction.

However, as illustrated in FIG. 9, as the spindle 166 rotates about the axle assembly 164 about the first axis in the second direction, the spindle again frictionally engages the cam 198. The inner surface 205 of the cam 198 will rotate about the second axis of the hub 186 in the second direction and the body portion 202 of the cam will rotate about the third axis in the second direction. The cam 198 will rotate in the second direction until the shelf 200 engages the stop member 194. At this second position, the third axis is spaced from the first and shaft axes and the outer surface 204 of body portion 202 extends beyond the edges 206 of the flanges 190*a*, 190*b*. The body portion 202 will engage the spindle 166 thereby preventing further rotation of the spindle in the second direction about the axle assembly 164. Thus, in the second position, the axle assembly 164 has a larger dimension than the inside diameter of the spindle 166 as the cam 198 rotates in the second direction about the hub 186. It will be appreciated that the cam 198 may not reach the second position. As the cam 198 rotates toward the second position, an interference between the axle assembly 164 and the spindle 166 is gradually created. This may stop rotation of the cam before the second position is reached.

Figure 11:
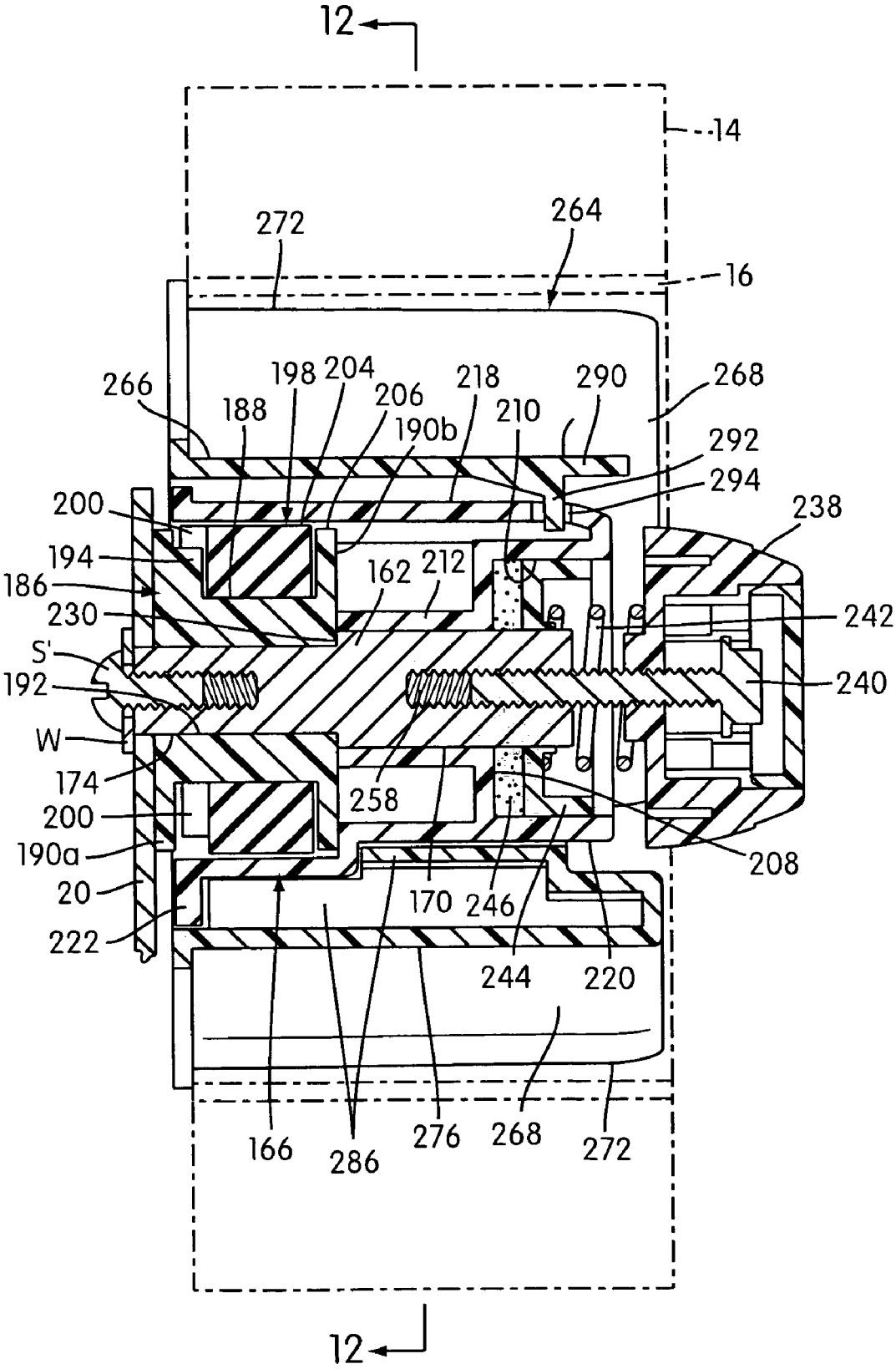
FIG. 11 is an assembled cross-sectional view of the axle assembly, the adapter and the tension adjustment assembly of the adhesive tape dispenser of FIG. 1.

The spindle 166 has an outer diameter sufficient to create a tight or interference fit with the inside of the first diameter tape core and is rotatably mounted on the axle assembly 164. With reference to FIGS. 7 and 11, the spindle includes a radial shelf 208 extending inward from an inner surface 210. Extending axially from an end of the shelf 208 is a flange 212, the shelf and flange defining an axial bore 214 dimensioned to receive the shaft 162. At least one axial rib 216 can be disposed on the external surface 218 of the spindle. The at least one axial rib creates an interference fit between the spindle 166 and the first diameter tape core thereby limiting slippage of the first diameter tape roll relative to the spindle. At least one planar surface 220 can be disposed adjacent the axial rib 216 on the external surface 218 of the spindle. In this embodiment, the spindle includes three pairs of ribs 216 and three planar surfaces 220 disposed symmetrically, in an alternating fashion, about the external surface 218 of the spindle. The spindle further includes a flange 222 extending radially outward from a first end 224 of the spindle. The flange further prevents the movement of the tape roll on the spindle.

With continued reference to FIG. 7, to secure the core support assembly 160 to the frame 20, the first portion 170 of the shaft 162 is inserted through the axle assembly 164 until the flange 190*b* abuts a shelf 230 defined by an outer surface of the shaft and the planar sections 174. The end 176 of the shaft, which will extend through the opening 192 in the hub 186, is then inserted into the opening 178 of the frame 20. A conventional screw S' extends through a washer W and the frame opening 178 and threadedly engages a mounting aperture (not shown) in the shaft end 176. It should be appreciated that a washer would not be needed for a screw having a head with a diameter greater than the frame opening 178. The spindle 166 is then placed over the shaft 162 and axle assembly 164 until the flange 190*b* abuts the end of the flange 212 extending from the shelf 208. Once the spindle 166 is properly secured, the second portion 172 of the shaft 162 will extend through the bore 214.

With reference again to FIG. 1, a tension adjustment assembly 236 is selectively secured to the shaft 162 for securing the spindle 166 to the axle assembly 164 and for providing variable resistance to rotation of the tape roll 14. The adjustment assembly includes an adjustment knob 238 which surrounds and operates a tension bolt 240 against a spring 242, against a friction disc 244 and against a Teflon or plastic wear ring 246. The wear ring is inserted into a recess 250 (FIG. 7) defined by the shelf 208, the spindle inner surface 210 and a second end 252 of the spindle. The friction disc, which is also inserted in the recess over the wear ring 246, includes an opening 254 (FIG. 10) dimensioned to receive an end 256 of the shaft second portion 172. The bolt 240 screws into a threaded aperture 258 located on the end of the shaft second portion.

Figure 10:
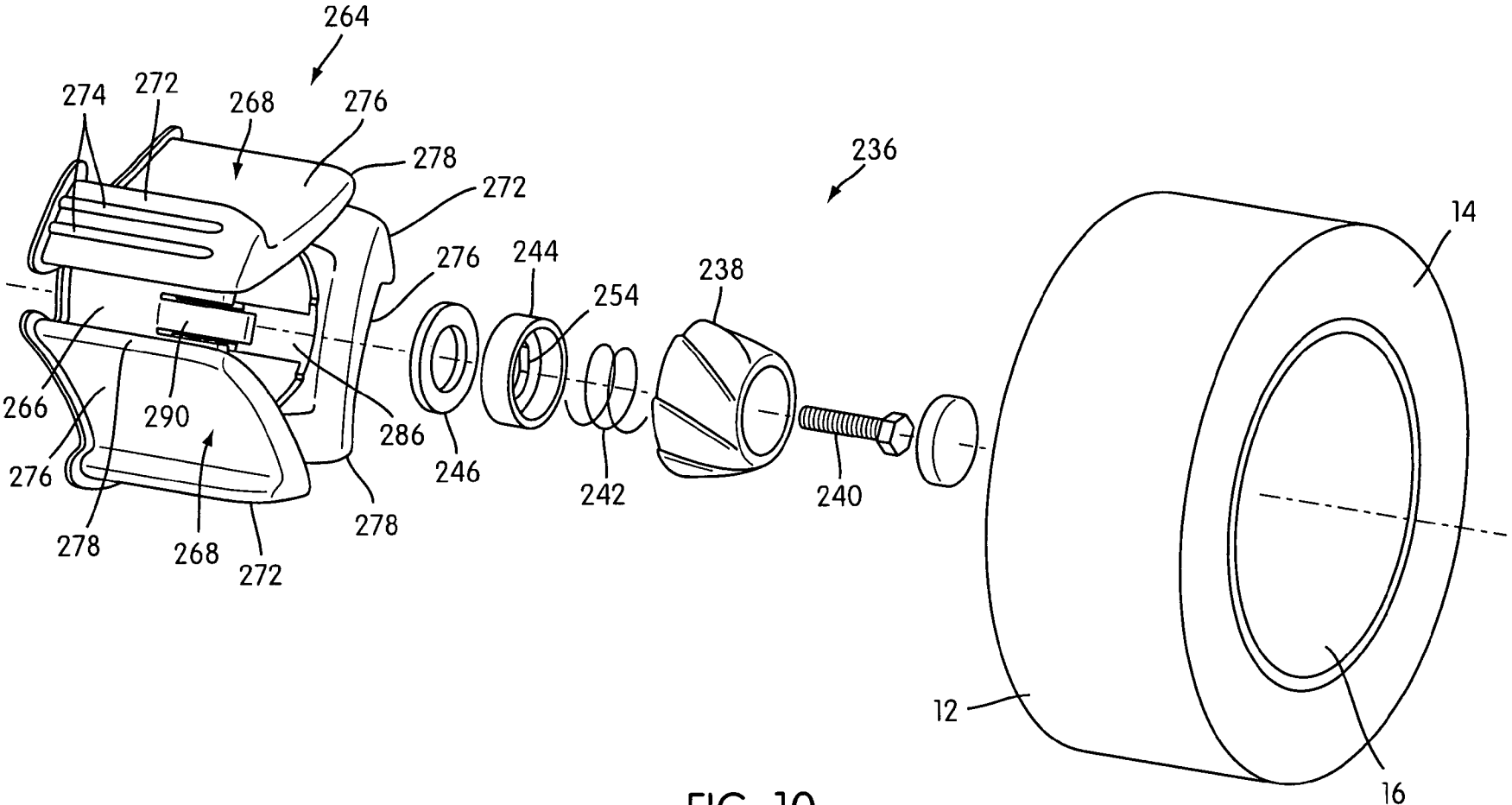
FIG. 10 is an enlarged exploded front perspective view of an adapter and tension adjustment assembly of the adhesive tape dispenser of FIG. 1.
Figure 12:
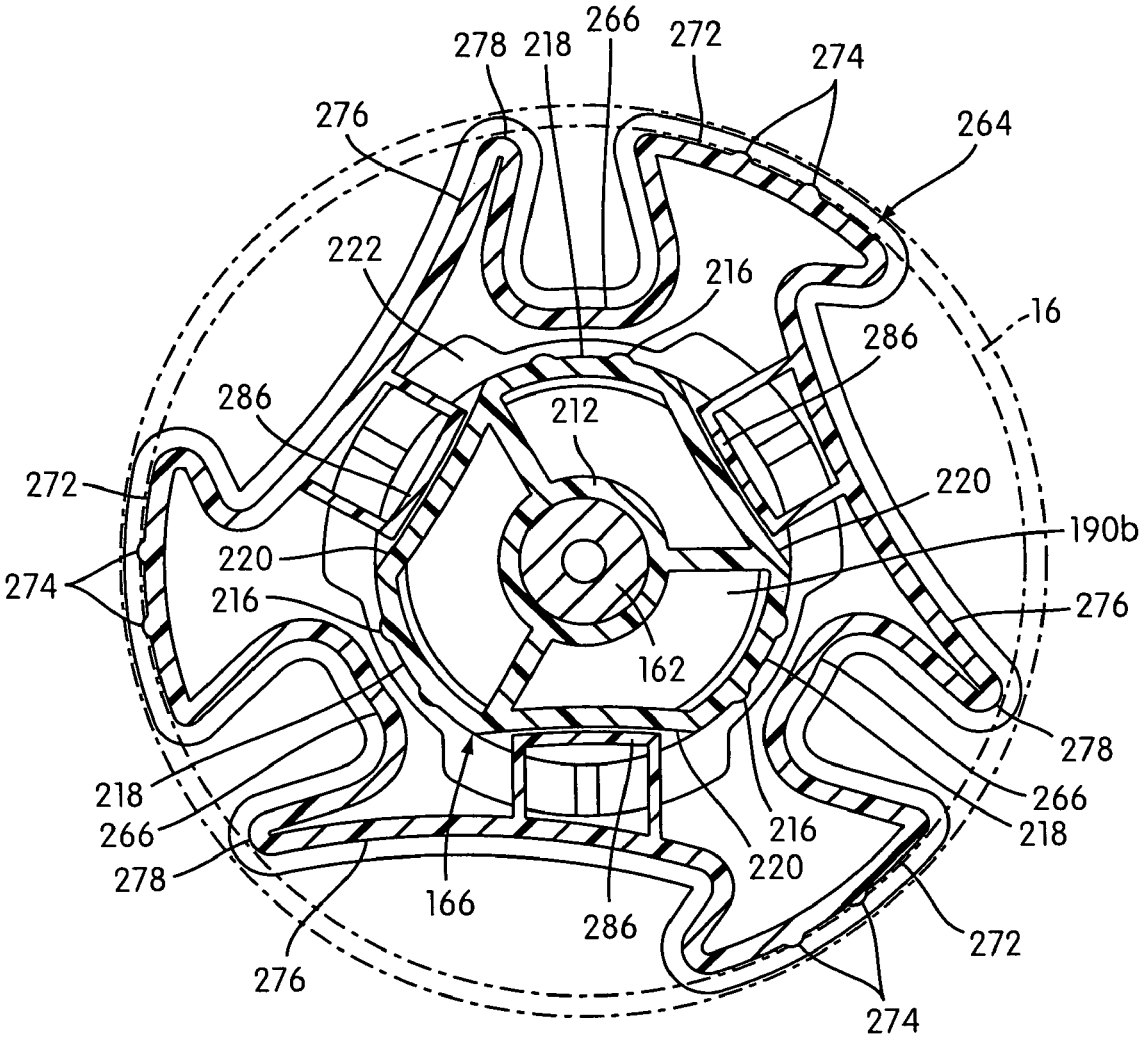
FIG. 12 is a cross-sectional view of FIG. 11 taken along line 12-12.

With reference now to FIG. 10, the tape dispenser 10 further includes an adapter 264, which is selectively secured to the spindle 166, for the tape roll 14 having the second diameter tape core 16. The adapter 264 includes an outer surface 266 having at least one contact member for frictionally engaging the tape core 16. In this embodiment, the outer surface 266 includes three contact members 268 disposed symmetrically on the outer surface about the first axis of the core support assembly 160. As illustrated in FIG. 12, each contact member 268 includes a face 272 having at least one axial rib 274 and a leg 276 extending from the face. The axial ribs 274 of the each face 272 and an end 278 of each leg 276 engage and support the tape core 16 in at least six locations. Each contact member 268, when viewed axially, has a check mark conformation, although, it should be appreciated by one skilled in the art that the contact members can have other geometric shapes so long as the tape core is sufficiently supported in multiple, preferably six locations.

As shown in FIGS. 11 and 12, the adapter 264 further includes at least one planar member 286 extending axially and radially from at least one leg 276 of the contact members 268. In this embodiment, the adapter includes three planar members 286. A portion of the planar members 286 engage the planar surfaces 220 of the spindle 166 thereby preventing rotation of the adapter relative to the spindle. A resilient finger 290 extends axially from the outer surface 266 of the adapter. The finger includes a tab 292 which extends radially inward from the finger. The tab 292 is secured in a corresponding slot 294 located on the external surface 218 of the spindle 166. The tab releasably secures the adapter 264 to the spindle 166.

Figure 13:
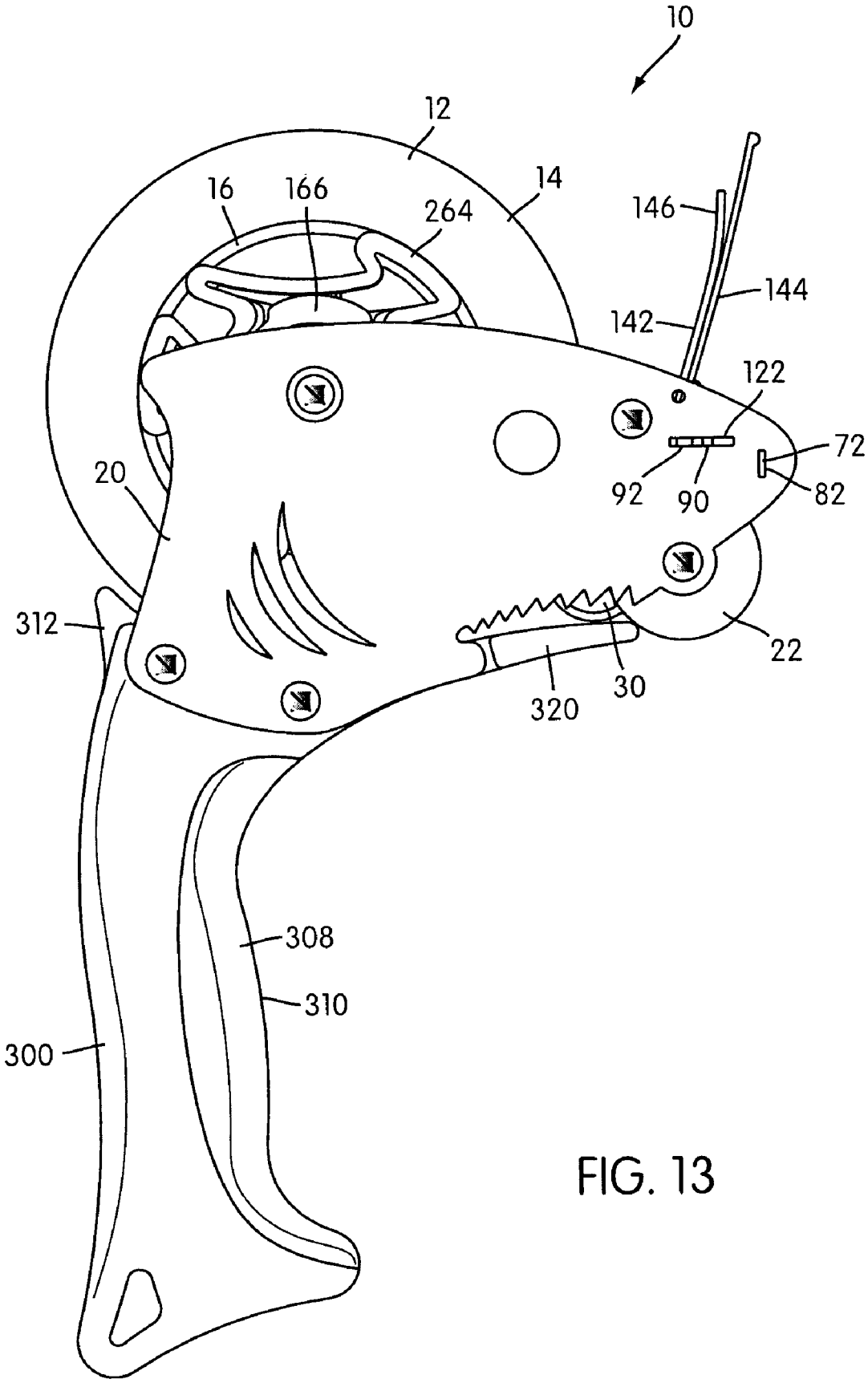
FIG. 13 is an assembled right side elevational view of the adhesive tape dispenser of FIG. 1.
Figure 14:
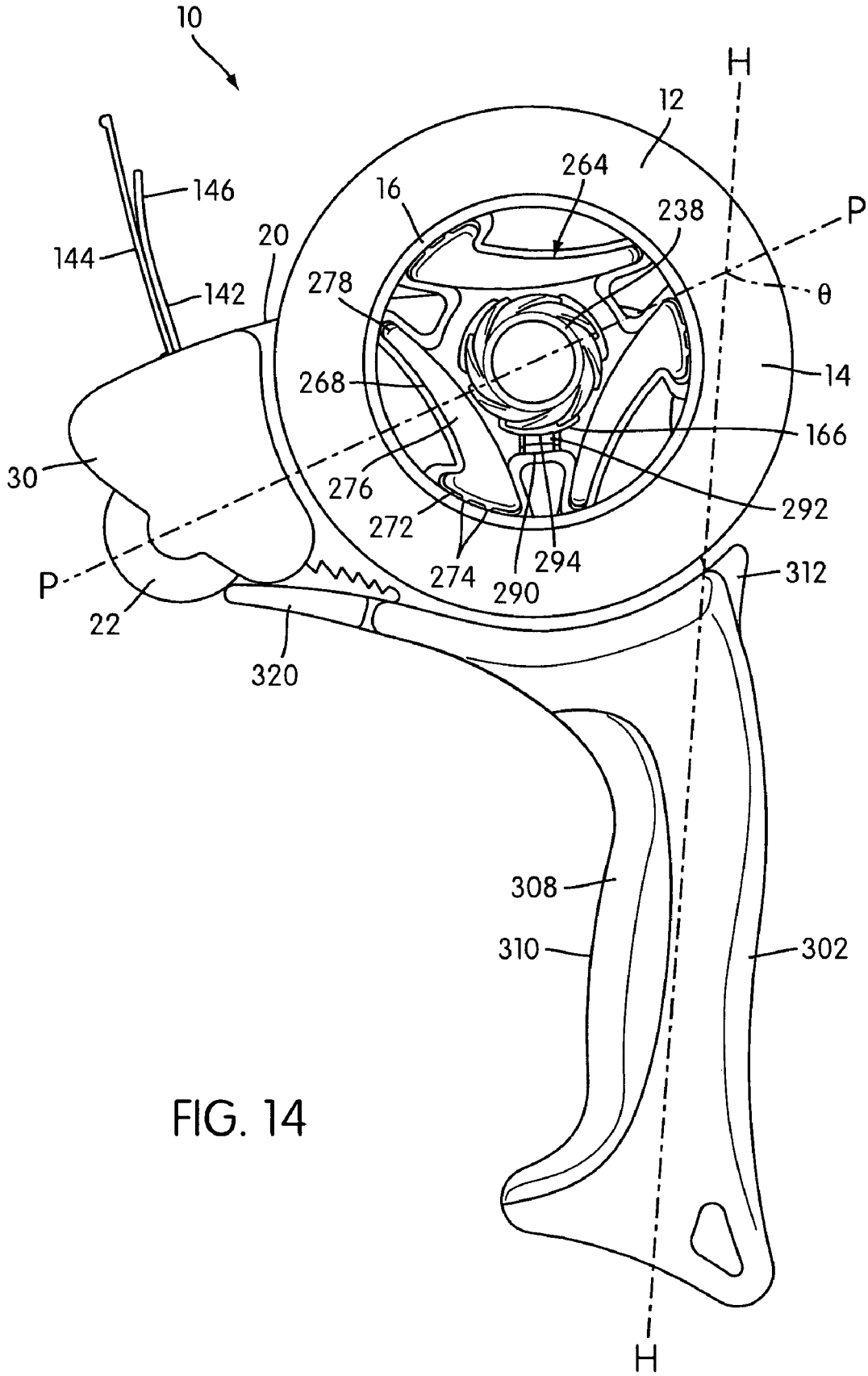
FIG. 14 is an assembled left side elevational view of the adhesive tape dispenser of FIG. 1.
Figure 15:
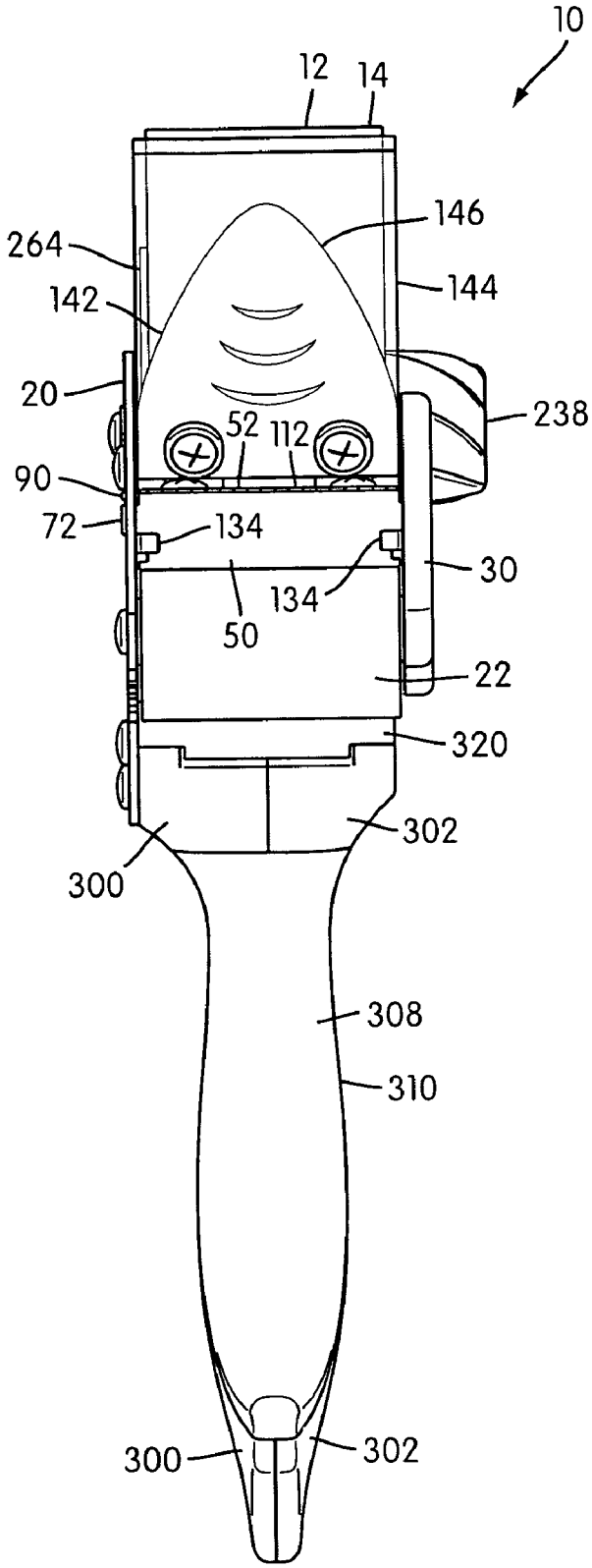
FIG. 15 is an assembled front plant view of the adhesive tape dispenser of FIG. 1.

The handle assembly 26, as shown in FIGS. 13-15, is mounted on the frame 20 for grasping and operating the tape dispenser 10. The handle assembly includes mating first and second portions 300, 302 and defines a longitudinal axis H-H. The first portion 300 includes a pair of mounting apertures 304 which are aligned with openings 40 in the frame. Conventional screws S extend through the openings 40 and threadedly engage the mounting apertures 304, thus securing the handle assembly 26 to the frame 20. A front section 306 of handle assembly 26 preferably contains a contoured grip 308 and an elastomeric coating 310 that assists a user in gripping the handle. A similar coating can be used in other portions of the tape dispenser 10, for example, on a thumb hold 312 on the top of the tape dispenser.

The handle assembly 26 further includes a gate 320 which may be opened to provide a wider space through which to thread a length of tape (not shown). The gate is below the application roller 22 which again is used to roll onto dispensed tape and against an object or surface to which the dispensed tape is being applied.

The ergonomic tape dispenser 10 of the present invention facilitates application of dispensed tape to a surface with minimum manipulation by the user. As shown in FIG. 14, the longitudinal axis H-H of the handle assembly 26 intersects at an acute angle Θ with a first plane P-P containing a center axis of the application roller 22 and the first axis of the core support assembly 160. The first axis of the core support assembly is spaced from the longitudinal axis H-H of the handle assembly 26 toward the application roller axis. As such, the core support assembly 160 acts as a mass creating a downward cantilevered effect on the tape dispenser 10 relative to the longitudinal axis of the handle assembly 26 thereby urging a front end of the tape dispenser 10 against a surface of a product. This optimizes positioning of the tape dispenser 10 at initial application of the dispensed adhesive tape onto a surface and final cutting of the tape roll.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. An adhesive tape dispenser adapted to dispense tape wound upon a tape core comprising:

a frame;

an application roller;

a cutter assembly mounted on the frame;

a handle mounted on the frame; and, a core support assembly secured to the frame and having a first axis, the core support assembly comprising:

a shaft secured to the frame;

an axle assembly disposed about at least a portion of the shaft, the axle assembly including a hub having an outer surface with a second axis adjacent the first axis, at least one flange extending radially from the hub, and a cam rotatably mounted on the hub; and, a spindle adapted to support the tape core rotatably mounted on the axle assembly, the spindle freely rotating in a first direction and wherein rotation of the spindle in a second direction rotates the cam about the second axis in the second direction whereby the cam engages the spindle preventing further rotation of the spindle in the second direction about the axle assembly.

2. The adhesive tape dispenser of claim 1 wherein the at least one flange of the axle assembly has an outside diameter smaller than an inside diameter of the spindle.

3. The adhesive tape dispenser of claim 1 wherein the hub of the axle assembly includes a stop member for limiting rotation of the cam in the first and second directions.

4. The adhesive tape dispenser of claim 3 wherein the stop member extends radially from the outer surface of the hub.

5. The adhesive tape dispenser of claim 1 wherein the cam includes a shelf for engaging the stop member.

6. The adhesive tape dispenser of claim 1 wherein an outside diameter of the cam is smaller than the inside diameter of the spindle as the cam rotates in the first direction about the second axis.

7. The adhesive tape dispenser of claim 1 further including a tension adjustment knob selectively secured to the shaft for securing the spindle to the axle assembly and for providing variable resistance to rotation of the tape roll.

8. The adhesive tape dispenser of claim 1 wherein the spindle includes at least one axial rib and has an outer diameter larger than an inside diameter of a tape core of adhesive tape, the at least one axial rib creating an interference fit between the spindle and the tape core thereby limiting slippage of the tape roll relative to the spindle.

9. The adhesive tape dispenser of claim 1 wherein the core support assembly further includes an adapter, the adapter being selectively secured to the spindle for a tape roll having a tape core having an inside diameter larger than the outer diameter of the spindle.

10. The adhesive tape dispenser of claim 9 wherein an outer surface of the adapter includes at least one contact member for frictionally engaging a tape core of tape roll.

11. The adhesive tape dispenser of claim 10 wherein the outer surface of the adapter includes three contact members disposed symmetrically about the first axis of the core support assembly.

12. The adhesive tape dispenser of claim 10 wherein the contact member includes a face having at least one axial rib and a leg extending from the face, the face and an end of the leg engaging and supporting a tape core of a tape roll.

13. The adhesive tape dispenser of claim 1 wherein the spindle rotates freely about the first axis of the core support assembly.

14. An anti-reverse hub assembly for an adhesive tape dispenser including a frame, a cutter assembly, an application roller and a handle mounted on the frame, and a spindle rotatably mounted on the hub assembly, the anti-reverse hub assembly comprising:

a shaft secured to the frame;

a generally cylindrical member disposed about a portion of the shaft;

at least one flange extending radially from the cylindrical member; and, a cam rotatably mounted on the cylindrical member.

15. The hub assembly of claim 14 wherein the cylindrical member includes an opening dimensioned to receive a portion of the shaft.

16. The hub assembly of claim 14 wherein the cylindrical member includes a radially extending stop member for limiting rotation of the cam about the cylindrical member.

17. The hub assembly of claim 16 wherein the cam includes an axial shelf for engaging the stop member.

18. The hub assembly of claim 14 wherein the hub assembly has a first dimension smaller than an inner diameter of the spindle as the cam rotates in a first direction about the cylindrical member.

19. The hub assembly of claim 18 wherein the hub assembly has a second dimension larger than the inner diameter of the spindle as the cam rotates in a second direction about the cylindrical member.

20. The hub assembly of claim 19 wherein a portion of the cam engages the spindle as the cam rotates in the second direction thereby preventing further rotation of the spindle in the second direction about the hub assembly.

21. The hub assembly of claim 14 wherein the shaft has a shaft axis; the cylindrical member has an outer surface having a first center axis; the cam has an interior surface having a second center axis; and the cam having a portion of an exterior surface having a third center axis, whereby the first and second axes are coincident but offset from the shaft axis and the third axis is selectively coincident with the shaft axis.

22. An adhesive tape dispenser comprising:

a frame;

an application roller;

a cutter assembly mounted on the frame;

a handle mounted on the frame;

a hub assembly rotatably secured to the frame;

a spindle adapted to support a roll of tape upon a core of a first diameter rotatably mounted on the hub assembly, the spindle including a slot located on an external surface of the spindle; and, a spindle adapter adapted to support a roll of tape upon a core of a second diameter larger than the first core diameter, the adapter including a resilient finger and a tab extending radially inward from the finger, the tab adapted to be secured in the slot of the spindle for selectively securing the spindle adapter to the spindle.

23. The adhesive tape dispenser of claim 22 wherein the spindle has a generally cylindrical conformation.

24. The adhesive tape dispenser of claim 22 wherein the spindle includes at least one raised axial rib disposed on the external surface, the at least one axial rib creating an interference fit between the spindle and the first diameter core of the roll of tape mounted on the spindle.

25. The adhesive tape dispenser of claim 22 wherein the spindle includes at least one planar surface disposed on the external surface of the spindle.

26. The adhesive tape dispenser of claim 25 wherein the spindle includes three planar surfaces disposed symmetrically about the external surface of the spindle.

27. The adhesive tape dispenser of claim 22 wherein the spindle includes a radially extending flange for further preventing axial movement of the tape roll.

28. The adhesive tape dispenser of claim 22 wherein the spindle adapter includes at least one planar member extending axially and radially from an internal surface of the spindle adapter.

29. The adhesive tape dispenser of claim 28 wherein the at least one planar member engages at least one planar surface of the spindle thereby preventing rotation of the spindle adapter relative to the spindle.

30. The adhesive tape dispenser of claim 22 wherein an outer surface of the spindle adapter includes at least one contact member for frictionally engaging the second diameter tape core of a tape roll.

31. The adhesive tape dispenser of claim 30 wherein the outer surface of the spindle adapter includes three contact members disposed symmetrically about the outer surface of the spindle adapter.

32. The adhesive tape dispenser of claim 30 wherein the at least one contact member includes a face having at least one axial rib and a leg extending from the face, the face and an end of the leg engaging and supporting the second diameter tape core of a tape roll.

33. The adhesive tape dispenser of claim 32 wherein the at least one contact member has a check mark conformation.

34. The adhesive tape dispenser of claim 22 wherein the hub assembly further includes an anti-reverse axle assembly.

35. An adhesive tape dispenser including a frame, a cutter assembly, an application roller and handle mounted on the frame, a hub assembly rotatably secured to the frame, a spindle rotatably mounted on the hub assembly and a spindle adapter selectively secured to the spindle, the spindle adapter adapted for a tape roll having a tape core having a diameter larger than an outer diameter of the spindle, the spindle adapter comprising:

three contact members symmetrically disposed about an outer surface of the spindle adapter, the contact members engaging and supporting the tape core in at least six locations around the tape core.

36. The adapter of claim 35 wherein each contact member includes a face having at least one axial rib and a leg extending from the face.

37. The adapter of claim 35 wherein each contact member, when viewed axially, has a check mark conformation.

38. The adapter of claim 35 further including a resilient finger and a tab extending radially inward from the finger, the tab being secured in a slot of the spindle for selectively securing the spindle adapter to the spindle.

* * * * *